US008450663B2

(12) United States Patent
Lewin

(10) Patent No.: US 8,450,663 B2
(45) Date of Patent: May 28, 2013

(54) ELECTRICAL HEATING ELEMENT FOR VERTICAL INSTALLATION

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 1143 days.

(21) Appl. No.: 11/916,835

(22) PCT Filed: May 24, 2006

(86) PCT No.: PCT/SE2006/060157

§ 371 (c)(1),
(2), (4) Date: Dec. 7, 2007

(87) PCT Pub. No.: WO2006/132590

PCT Pub. Date: Dec. 14, 2006

(65) Prior Publication Data

US 2010/0193504 A1 Aug. 5, 2010

(30) Foreign Application Priority Data

Jun. 9, 2005 (SE) ..... 0501314

(51) Int. Cl.
*H05B 3/02* (2006.01)

(52) U.S. Cl.
USPC ..... 219/548; 219/552; 219/523

(58) Field of Classification Search
USPC .. 219/548, 552, 544, 530, 531, 553; 373/132, 373/133, 134; 338/234, 235, 236, 237; 392/480, 392/497, 488, 503
See application file for complete search history.

(56) References Cited

U.S. PATENT DOCUMENTS

| | | | | | |
|---|---|---|---|---|---|
| 1,618,364 | A | * | 2/1927 | Clark et al. | 219/536 |
| 2,790,889 | A | * | 4/1957 | Hynes | 392/488 |
| 3,571,566 | A | * | 3/1971 | Kuzara | 219/536 |
| 4,011,395 | A | * | 3/1977 | Beck | 373/134 |
| 4,016,403 | A | * | 4/1977 | Best | 219/550 |
| 4,179,603 | A | | 12/1979 | Zeigler et al. | |
| 4,272,639 | A | | 6/1981 | Beck | |
| RE30,838 | E | * | 12/1981 | Best | 219/550 |
| 4,322,606 | A | * | 3/1982 | Bayly | 219/550 |
| 4,771,166 | A | * | 9/1988 | McGuire et al. | 219/532 |

(Continued)

FOREIGN PATENT DOCUMENTS

WO 2005/006812 A1 1/2005

OTHER PUBLICATIONS

International Search Report included in Published PCT Application Serial No. PCT/SE2006/050157 Published Dec. 14, 2006.

*Primary Examiner* — Geoffrey S Evans
*Assistant Examiner* — James Sims, III
(74) *Attorney, Agent, or Firm* — Morgan, Lewis & Bockius LLP

(57) ABSTRACT

An electrical heating element for vertical installation includes vertically suspended electrical resistance elements for the heating of furnaces in industrial operation, where each resistance element is formed of conductive legs, where along the length of the resistance elements are placed ceramic disks provided with holes, through which holes the relevant legs of the element pass. The ceramic disks are arranged between ceramic tubes and an upper metallic central rod is positioned within the ceramic tubes, which central rod supports the element and where the element is surrounded by a radiative tube. There are a number of upper ceramic tubes outside of the upper central rod with intermediate ceramic disks, and the central rod extends a certain distance down into the radiative tube.

20 Claims, 1 Drawing Sheet

Figure 1:
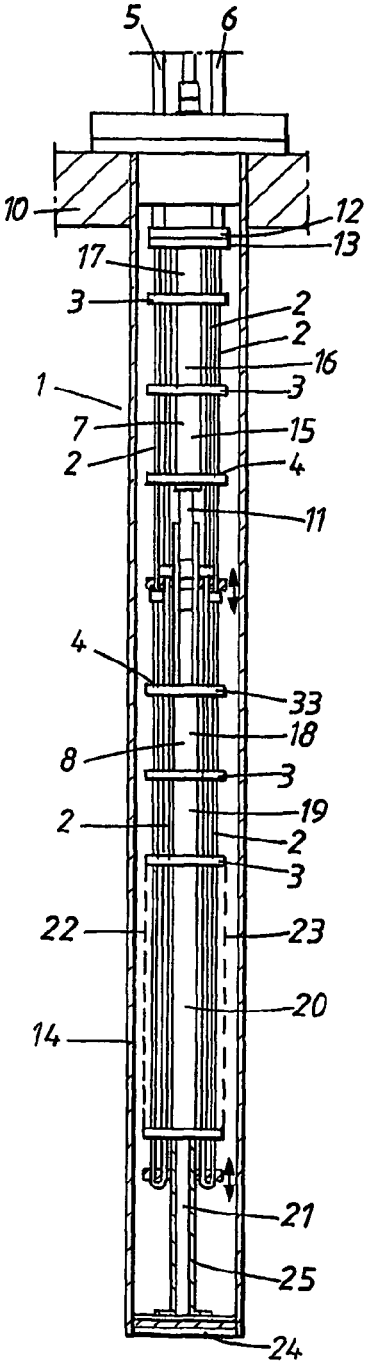

U.S. PATENT DOCUMENTS 4,813,805 A * 3/1989 Dagata ..... 403/32
5,338,918 A 8/1994 Eshleman
5,473,141 A * 12/1995 Makris et al. ..... 219/544
5,497,394 A * 3/1996 Jhawar et al. ..... 373/130
5,543,603 A * 8/1996 Schmadig et al. ..... 219/550
7,439,473 B2 * 10/2008 Lewin ..... 219/544
7,576,306 B2 * 8/2009 Lewin ..... 219/552
7,692,122 B2 * 4/2010 Lewin et al. ..... 219/520

* cited by examiner

ELECTRICAL HEATING ELEMENT FOR VERTICAL INSTALLATION

BACKGROUND OF THE INVENTION

1. Field of the Invention

The present invention relates to an electrical heating element for vertical installation.

2. Description of the Related Art

This type of heating element has a number of resistance elements that run vertically, which resistance elements are supported by a central rod that is fixed attached to a furnace ceiling or similar. A radiative tube is positioned outside of the resistance elements, which radiative rod surrounds the resistance elements.

Such resistance elements are used principally for the heating of furnaces in industrial use. The elements consist of molybdenum silicides or an alloy of molybdenum silicide or Fe—Cr—Al material or Ni—Cr or Ni—Cr—Fe material.

Each element consists of conducting legs that run downwards and upwards a number of times. The resistance element at the top transitions into a number of terminals, which are connected to one or several sources of power. The resistance element thus hangs from the ceiling of the furnace, and extends vertically downwards during operation. The legs are exposed during operation to severe thermal variation, as a result of the development of power in the legs. The consequence of this variation is that the individual legs of the element are bent or twisted when the temperature is changed. A number of ceramic disks, therefore, are placed along the length of the element, provided with holes, through which holes the particular legs of the element pass. The function of these disks is to maintain the separation of the legs of the element such that these do not make contact with each other. Should such a contact arise, the element will be short-circuited, resulting in destruction of the element.

The ceramic disks are held in place by ceramic rods and ceramic tubes.

The uppermost ceramic disk supports, or the uppermost disks support, the weight of the resistance elements. This takes place according to the prior art in that the legs are connected in pairs with the aid of conducting plates, which plates, depending of the actual geometry of the resistance element, rest on the uppermost ceramic disk or disks. Thus the legs run in pairs through a suspension ceramic disk and are connected at the upper surface of the ceramic disk by such a conducting plate and are supported in this way by the ceramic disk.

The uppermost ceramic disk is attached, or the uppermost ceramic disks are attached, to a central rod of a metallic material.

The uppermost ceramic disk supports, or the uppermost ceramic disks support also the weight of the ceramic items that are present.

It is required to produce long such elements. It is a wish that the heating element should have a length that exceeds 2,500 mm. At such a length, the length is such that the thermal expansion of the resistance elements can no longer be managed.

This is a result of the fact that at high temperatures and when using long elements, the mechanical load on the metallic central rod, which supports the weight of the resistance elements and the said ceramic items that ensure the relative positions of the resistance elements, becomes so great that the rod becomes deformed.

Thus, the basic problem is that the weight of the resistance elements and the necessary ceramic items becomes too great.

SUMMARY OF THE INVENTION

The present invention solves this problem and allows the design of resistance elements with a length that exceeds 2,500 mm.

The present invention thus relates to an electrical heating element for vertical installation, comprising vertically suspended electrical resistance elements for the heating of furnaces in industrial operation, where each element consists of conductive legs that run downwards and upwards a number of times, where along the length of the element there are placed a number of ceramic disks provided with holes, through which holes the relevant legs of the element pass, and where the element at its upper end transitions into terminals that are connected to a source of power, where the said ceramic disks are arranged between ceramic tubes and where an upper metallic central rod is positioned within the ceramic tubes, which central rod is fixed to the ceiling of the furnace and which supports the element through at least one of the uppermost of the said ceramic disks and where the element is surrounded by a radiative tube, and it is characterised in that there are a number of upper ceramic tubes outside of the upper central rod, with intermediate ceramic disks, in that the ceramic disks are positioned at a distance from each other and outside of the central rod, in that the central rod extends a certain distance down into the radiative tube, in that a number of lower ceramic tubes with intermediate ceramic disks are positioned outside of a lower central rod, in that the ceramic disks are positioned at a distance from each other and outside of the lower central rod, in that the lower central rod extends a certain distance up from the bottom of the radiative tube to a level somewhat lower than the lower end of the upper central rod, and in that the lower central rod and the lowermost of the lower ceramic tubes are supported by the bottom of the radiative tube, whereby the weight of the to lower central rod and its associated ceramic items is supported by the radiative tube.

BRIEF DESCRIPTION OF THE DRAWING FIGURES

Figure 2:
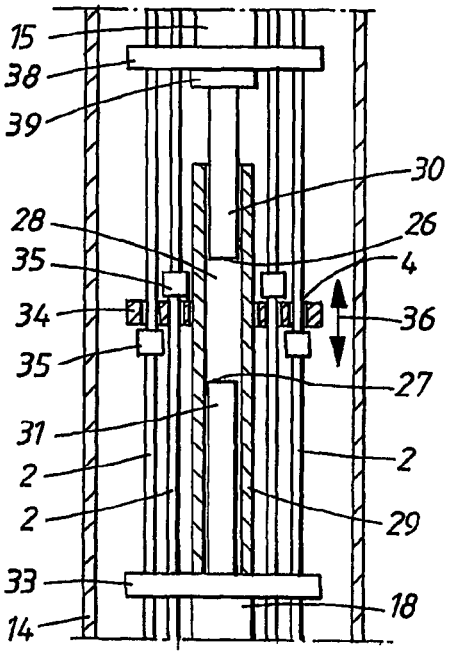
Figure 3:
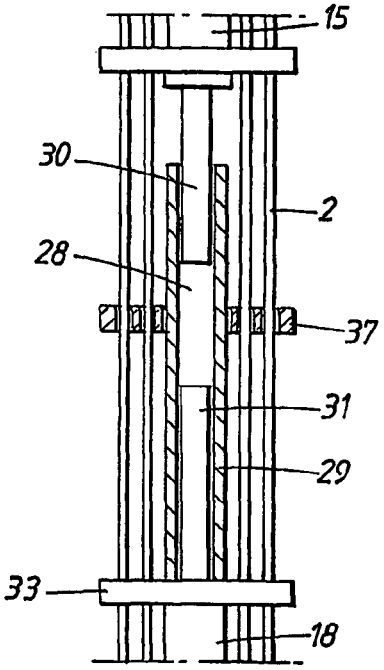

The invention will be described in more detail below, partially in association with the attached drawings, where FIG. 1 shows an electrical heating element according to the invention with the radiative tube cut away FIG. 2 shows a central part of the electrical heating element at a larger scale according to a first embodiment FIG. 3 shows a central part of the electrical heating element at a larger scale according to a second embodiment.

DETAILED DESCRIPTION OF THE INVENTION

FIG. 1 shows an electrical heating element 1 for vertical installation comprising vertically suspended electrical resistance elements 2 for heating furnaces in industrial operation. The reference numeral 10 in FIG. 1 denotes a furnace ceiling into which the electrical heating element is fixed. Each element consists of conductive legs running downwards and upwards a number of times. A number of ceramic disks 3 are located along the length of the element 2 provided with holes 4, through which holes the relevant legs of the element 2 pass. The upper part of the element transitions into terminals 5, 6, which are connected to a source of power. The said ceramic disks 3 are arranged outside of ceramic tubes 7, 8, where a metallic central rod is placed within the ceramic tubes. An upper central rod 11 is attached to the furnace ceiling 10. This upper central rod 11 supports the element 2 through at least one of the uppermost 12, 13 of the said ceramic disks. The element 2 is surrounded by a radiative tube 14.

Outside of the upper central rod there are, according to the invention, a number of upper ceramic tubes 15, 16, 17 with intermediate ceramic disks 3. The ceramic disks 3 are located at a distance from each other and outside of the central rod 11. The central rod 11 extends a certain distance down into the radiative tube 14. Furthermore, there are a number of lower ceramic tubes 18, 19, 20 with intermediate ceramic disks 3 outside of a lower central rod 21. The dashed lines 22, 23 in FIG. 1 suggest a number of ceramic disks 3 with intermediate ceramic tubes. The ceramic disks 3 are located at a distance from each other and outside of the lower central rod 21. The lower central rod 21 extends up from the bottom 24 of the radiative tube 14 to a level that lies somewhat below the lower end of the upper central rod 11. It is, furthermore, a significant property that the lower central rod 21 and the lowermost 25 of the lower ceramic tubes make contact with the bottom 24 of the radiative tube 14, whereby the weight of the lower central rod 21 and its associated ceramic items 3, 18, 19, 20, 21 are supported by the radiative tube 14, which is fixed attached to the upper part of the heating element.

According to one preferred embodiment, see FIG. 2, between the lower end 26 of the upper central rod 11 and the upper end 27 of the lower central rod 21 there is a zone 28 arranged to absorb the difference in length of the elements 2 as a result of the temperature of the elements and the expansion of the radiative tube.

It is preferred that the said zone 28 comprises a ceramic sheath 29 that surrounds the lower part 30 of the upper central rod 11 and the upper part 31 of the lower central rod 21, where the end surfaces 26, 27 of the central rods are located at a distance from each other independent of the current temperature. The ceramic sheath 29 is supported by the uppermost ceramic disk 33 of the lower ceramic disks 33, 3, 23.

According to a first embodiment shown in FIG. 2, a ceramic disk 34 is arranged outside of the ceramic sheath 29, which disk 34 can be displaced along the sheath 29. The ceramic disk 34 is anchored to the element 2 by means of pegs 35 such that the ceramic disk cannot be displaced along the element. The disk 34 can thus be displaced along the sheath 29, as the arrow 36 demonstrates, when the length of the element changes as a result of its temperature.

The lowermost ceramic disk 38 of the upper ceramic disks is supported in FIG. 2 by a plate 39 that is attached to the upper central rod 11.

According to a further preferred embodiment, the element 2 can be displaced relative to all ceramic disks except for the uppermost ceramic disk or disks 12, 13 and the ceramic disk 34 that is located in the said zone 28.

According to a second embodiment shown in FIG. 3, a ceramic disk 37 is arranged outside of the ceramic sheath 29, which disk 37 is attached to the sheath. In this case, the disk 37 moves relative to the element 2 when its length changes.

In the case of the second of the said embodiments, it is preferred that the element 2 can be displaced relative to all ceramic disks except for the uppermost disk or disks 12, 13.

There is thus achieved through the present invention a reduction of load with respect to the mechanical load on the metallic central rod that supports the weight of the resistance elements and the said ceramic items that ensure the relative positions of the resistance elements, whereby deformation of the upper central rod is avoided.

A number of embodiments have been described above. It is however obvious that heating elements of the specified type can be constructed for instance with more or fewer ceramic disks with intermediate ceramic tubes.

The present invention is therefore not to be regarded as being limited to the embodiments specified above, since it can be varied within the scope of the attached patent claims.

The invention claimed is:

1. An electrical heating element for vertical installation, comprising:

a plurality of vertically suspended electrical resistance elements configured for heating of furnaces in industrial operation, where each electrical resistance element is formed from conductive legs that run downwards and upwards a number of times;

a plurality of ceramic disks along a length of each electrical resistance element, the ceramic disks being provided with holes through which the relevant conductive legs of the electrical resistance element pass;

upper end transitions of each electrical resistance element disposed into terminals that are connected to a source of power;

a plurality of ceramic tubes between which the ceramic disks are arranged;

an upper metallic central rod positioned within the ceramic tubes, the upper metallic central rod being fixed to a ceiling of a furnace, the upper metallic central rod supporting each electrical resistance element through at least one of an uppermost disk of the ceramic disks;

a single radiative tube surrounding the electrical resistance elements;

a plurality of upper ceramic tubes outside of the upper metallic central rod, with the ceramic disks being positioned at a distance from each other and outside of the upper metallic central rod, and the upper metallic central rod extending a distance down into the radiative tube; and a plurality of lower ceramic tubes with ceramic disks being intermediate and positioned outside of a lower central rod, the ceramic disks being positioned at a distance from each other and outside of the lower central rod, the lower central rod extending a distance up from a bottom of the radiative tube to a level lower than a lower end of the upper metallic central rod, the lower central rod being supported by the bottom of the radiative tube, the lowermost of the lower ceramic tubes being supported by the bottom of the radiative tube, a weight of the lower central rod, the ceramic disks, and the lower ceramic tubes being supported by the radiative tube, wherein a zone is arranged between a lower end of the upper metallic central rod and an upper end of the lower central rod, wherein the zone comprises a ceramic sheath that surrounds a lower part of the upper metallic rod and an upper part of the lower central rod, wherein end surfaces of the central rods are situated at a distance from each other, and wherein the ceramic sheath is supported by an uppermost ceramic disk of the lower ceramic disks.

2. The electrical heating element according to claim 1, wherein the electrical resistance element is displaced relative to all ceramic disks except for the uppermost ceramic disk or disks and the ceramic disk that is located in the zone.

3. The electrical heating element according to claim 1, wherein the electrical resistance element is displaced relative to all ceramic disks except for the uppermost ceramic disk or disks.

4. The electrical heating element according to claim 1, wherein:

the lower central rod is supported by direct contact with the bottom of the radiative tube; and the lowermost of the lower ceramic tubes are supported by direct contact with the bottom of the radiative tube.

5. The electrical heating element according to claim 1, wherein the ceramic disk is attached to the sheath such that the ceramic sheath is configured to move relative to the electrical resistance element when the length of the electrical resistance element changes.

6. The electrical heating element according to claim 1, wherein a ceramic disk is arranged outside of the ceramic sheath, the ceramic disk being attached at the sheath.

7. The electrical heating element according to claim 6, the electrical resistance element is displaced relative to all ceramic disks except for the uppermost ceramic disk or disks.

8. The electrical heating element according to claim 1, wherein:

a ceramic disk is arranged outside of the ceramic sheath, the ceramic disk being displaced along the sheath; and the ceramic disk is anchored at the electrical resistance element such that the ceramic disk is not displaced along the electrical resistance element.

9. The electrical heating element according to claim 8, wherein the electrical resistance element is displaced relative to all ceramic disks except for the uppermost ceramic disk or disks and the ceramic disk that is located in the zone.

10. An electrical heating element for vertical installation, comprising:

a plurality of vertically suspended electrical resistance elements configured for heating of furnaces in industrial operation, where each electrical resistance element is formed from conductive legs that run downwards and upwards a number of times;

a plurality of ceramic disks along a length of each electrical resistance element, the ceramic disks being provided with holes through which relevant conductive legs of the electrical resistance elements pass;

upper end transitions of each electrical resistance element disposed into terminals that are connected to a source of power;

a plurality of ceramic tubes between which the ceramic disks are arranged;

an upper metallic central rod positioned within the ceramic tubes, the upper metallic central rod being fixed to a ceiling of a furnace, the upper metallic central rod supporting each electrical resistance element through at least one of an uppermost disk of the ceramic disks;

a single radiative tube fixed at an upper part of the heating element, the radiative tube surrounding the electrical resistance elements;

a plurality of upper ceramic tubes outside of the upper metallic central rod, with the ceramic disks being positioned at a distance from each other and outside of the upper metallic central rod, and the upper metallic central rod extending a distance down into the radiative tube; and a plurality of lower ceramic tubes with ceramic disks being intermediate and positioned outside of a lower central rod, the ceramic disks being positioned at a distance from each other and outside of the lower central rod, the lower central rod extending a distance up from a bottom of the radiative tube to a level lower than a lower end of the upper metallic central rod, the lower central rod being supported by the bottom of the radiative tube, the lowermost of the lower ceramic tubes being supported by the bottom of the radiative tube, a weight of the lower central rod, the ceramic disks, and the lower ceramic tubes being supported by the radiative tube.

11. The electrical heating element according to claim 10, wherein:

the lower central rod is supported by direct contact with the bottom of the radiative tube; and the lowermost of the lower ceramic tubes are supported by direct contact with the bottom of the radiative tube.

12. The electrical heating element according to claim 10, wherein:

a ceramic disk is arranged outside of a ceramic sheath that surrounds a lower part of the upper metallic central rod and an upper part of the lower central rod;

the ceramic disk is displaced along the sheath; and the ceramic disk is anchored by pegs at the electrical resistance element such that the ceramic disk is not displaced along the electrical resistance element.

13. The electrical heating element according to claim 10, wherein:

a ceramic disk is arranged outside of a ceramic sheath that surrounds a lower part of the upper metallic central rod and an upper part of the lower central rod; and the ceramic disk is attached to the sheath such that the ceramic sheath is configured to move relative to the electrical resistance element when the length of the electrical resistance element changes.

14. The electrical heating element according to claim 10, wherein a zone is arranged between a lower end of the upper metallic central rod and an upper end of the lower central rod to absorb a difference in length of the electrical resistance elements that results from a temperature of the electrical resistance elements and an expansion of the radiative tube.

15. The electrical heating element according to claim 14, wherein the electrical resistance element is displaced relative to all ceramic disks except for the uppermost ceramic disk or disks.

16. The electrical heating element according to claim 14, wherein:

the zone comprises a ceramic sheath that surrounds a lower part of the upper central rod and an upper part of the lower central rod;

the end surfaces of the central rods are situated at a distance from each other; and the ceramic sheath is supported by an uppermost ceramic disk of the lower ceramic disks.

17. An electrical heating element for vertical installation, comprising:

a plurality of vertically suspended electrical resistance elements configured for heating of furnaces in industrial operation, where each electrical resistance element is formed from conductive legs that run downwards and upwards a number of times;

a plurality of ceramic disks along a length of each electrical resistance element, the ceramic disks being provided with holes through which the relevant conductive legs of the respective electrical resistance element pass;

upper end transitions of each electrical resistance element disposed into terminals that are connected to a source of power;

a plurality of ceramic tubes between which the ceramic disks are arranged;

an upper metallic central rod positioned within the ceramic tubes the upper metallic central rod being fixed to a ceiling of a furnace, the upper metallic central rod supporting each electrical resistance element through at least one of an uppermost disk of the ceramic disks;

a single radiative tube surrounding the resistance elements;

a plurality of upper ceramic tubes outside of the upper metallic central rod, with the ceramic disks being positioned at a distance from each other and outside of the upper metallic central rod extending a distance down into the radiative tube; and a plurality of lower ceramic tubes with ceramic disks being intermediate and positioned outside of a lower central rod, the ceramic disks being positioned at a distance from each other and outside of the lower central rod, the lower central rod extending a distance up from a bottom of the radiative tube to a level lower than a lower end of the upper metallic central rod, the lower central rod being supported by the bottom of the radiative tube, the lowermost of the lower ceramic tubes being supported by the bottom of the radiative tube, a weight of the lower central rod, the ceramic disks, and the lower ceramic tubes being supported by the radiative tube, wherein a zone is arranged between a lower end of the upper metallic central rod and an upper end of the lower central rod, to absorb a difference in length of the electrical resistance elements that results from a temperature of the electrical resistance elements and an expansion of the radiative tube, and wherein the electrical resistance element is displaced relative to all ceramic disks except for the uppermost ceramic disk or disks and the ceramic disk that is located in the said zone.

18. The electrical heating element according to claim 17, wherein:

the lower central rod is supported by direct contact with the bottom of the radiative tub; and the lowermost of the lower ceramic tubes are supported by direct contact with the bottom of the radiative tube.

19. The electrical heating element according to claim 17, wherein:

a ceramic disk is arranged outside of a ceramic sheath that surrounds a lower part of the upper metallic central rod and an upper part of the lower central rod;

the ceramic disk is displaced along the sheath; and the ceramic disk is anchored by pegs at the electrical resistance element such that the ceramic disk is not displaced along the electrical resistance element.

20. The electrical heating element according to claim 17, wherein:

a ceramic disk is arranged outside of a ceramic sheath that surrounds a lower part of the upper metallic central rod and an upper part of the lower central rod; and the ceramic disk is attached to the sheath such that the ceramic sheath is configured to move relative to the electrical resistance element when the length of the electrical resistance element changes.

* * * * *